US006616139B2

(12) United States Patent
Aesch

(10) Patent No.: US 6,616,139 B2
(45) Date of Patent: Sep. 9, 2003

(54) DEVICE FOR REMOVING PRINTED PRODUCTS TRANSPORTED UNIFORMLY SPACED ON A TRANSPORT DEVICE

(75) Inventor: Beat von Aesch, Schönenwerd (CH)

(73) Assignee: Grapha-Holding AG, Hergiswil (CH)

( * ) Notice: Subject to any disclaimer, the term of this patent is extended or adjusted under 35 U.S.C. 154(b) by 0 days.

(21) Appl. No.: 09/827,703

(22) Filed: Apr. 6, 2001

(65) Prior Publication Data

US 2001/0032774 A1 Oct. 25, 2001

(30) Foreign Application Priority Data

Apr. 19, 2000 (EP) ..... 00810340

(51) Int. Cl.[7] ..... B65H 29/04

(52) U.S. Cl. ..... 271/204; 198/644; 198/470.1; 271/3.18; 271/252

(58) Field of Search ..... 198/644, 803.7, 198/867.08, 865.05, 470.1, 475.1, 478.1, 468.2; 271/204, 252, 268, 277, 3.18, 3.21, 3.24, 206

(56) References Cited

U.S. PATENT DOCUMENTS

| | | | | |
|---|---|---|---|---|
| 3,026,989 A | * | 3/1962 | Schaltegger | |
| 4,482,141 A | | 11/1984 | Moser | |
| 4,905,818 A | * | 3/1990 | Houseman | 198/470.1 |
| 5,261,520 A | * | 11/1993 | Duke | 198/375 |
| 5,374,093 A | * | 12/1994 | Klopfenstein | 271/204 |
| 5,395,151 A | * | 3/1995 | Eberle | 198/803.9 |
| 5,645,679 A | * | 7/1997 | Hansch | 156/566 |
| 6,182,960 B1 | * | 2/2001 | Keller et al. | 198/470.1 |
| 6,227,588 B1 | * | 5/2001 | Cassoni | 198/803.9 |
| 6,234,300 B1 | * | 5/2001 | De Vos et al. | 198/370.03 |

FOREIGN PATENT DOCUMENTS

| | | |
|---|---|---|
| DE | 4307712 | 2/1994 |
| EP | 0771675 | 5/1997 |

* cited by examiner

*Primary Examiner*—Christopher P. Ellis
*Assistant Examiner*—Richard Ridley
(74) *Attorney, Agent, or Firm*—Friedrich Kueffner

(57) ABSTRACT

A device for removing printed products, having a fold and being transported uniformly spaced and astraddle by a transport device, has a rotatingly driven gripping device with controlled gripping elements for gripping one of the printed products by the fold on the transport device and removing the printed product while stably holding the printed product. The rotatingly driven gripping device has control elements for controlling an opening movement and a closing movement of the gripping elements and is adjustable for adaptation to the different thicknesses of the printed products during running.

17 Claims, 6 Drawing Sheets

DEVICE FOR REMOVING PRINTED PRODUCTS TRANSPORTED UNIFORMLY SPACED ON A TRANSPORT DEVICE

BACKGROUND OF THE INVENTION

1. Field of the Invention

The invention relates to a device for removing printed products transported uniformly spaced and astraddle on a transport device, wherein the device comprises a rotatingly driven gripping device with controlled gripping elements which grip a printed product on the transport device in the area of folding and remove it while maintaining it in a stable position.

2. Description of the Related Art

A device of the aforementioned kind is known in the prior art, for example, in EP 0 771 675 A1, assigned to the instant assignee. This device has a clamping device which describes a circular travel path and picks up a single printed product while being transported and removes it in a position-stable fashion from a conveying chain and supplies it to a further processing device. This device is used, in particular, for gather-stitcher devices and has been proven successful in practice. Such devices are also referred to as deliveries. A further device of this kind is known from U.S. Pat. No. 4,482,141.

In the known device it is important that the printed products while being transported are safely gripped by the grippers and are removed from the transport device in a position-stable way. The printed products to be removed can be of very different thickness.

Printed products are known which are comprised only of a thin sheet and which are very lightweight and unstable. On the other hand, very thick, and correspondingly heavy, printed products must be processed. For a high transport output, in particular, in the case of very thin as well as very thick products disruptions can occur which can be avoided only with very complicated adjusting processes.

SUMMARY OF THE INVENTION

It is an object of the invention to provide a device of the aforementioned kind such that printed products having very different thicknesses can be processed safer, faster and with less adjusting work.

In accordance with the present invention, this is achieved in that the control means, which are provided for the closing movement and/or opening movement of the gripping means, are adjustable during operation for adaptation to the thickness of the printed products.

According to the invention, control means are provided for the movement of the gripping means which control means, for adjustment to the thickness of the printed products, can be readjusted during operation or running. By adjusting the control means it is possible to adjust the clamping force of the gripping means precisely to the thickness of the printed product being transported. Preferably, for this purpose the thickness of the printed product is measured by means of a measuring device. Based on the measured thickness, the closing movement of the gripping means is controlled such that the printed products are gripped with optimal clamping force. Since the movement can be readjusted during operation, a readjustment is thus possible, even at high conveying output, so that printed products of very different thicknesses can be successively processed without any interruption. For each gripping cycle, the closing movement can be adjusted by readjusting precisely to the thickness of the printed product. For example, printed products of a thickness of, for example, 1 mm, and, subsequently, one of a thickness of 20 mm, can be gripped with an optimal clamping force, respectively.

It was found that the control means can be adjusted very quickly with mechanical means, for example, within 100 milliseconds.

According to a further embodiment of the invention, two grippers are controlled by means of a lever which has a roller that is pressed against a control curve of a curve ring. By means of a control disc, this curve ring is moved during operation horizontally such that the position of the aforementioned control curve is changed. The movement of this curve ring is carried out preferably by means of a further control disc which also has a control curve and is adjustable during operation on curve levers fixedly mounted on the frame.

The adjustment is carried out according to a further embodiment of the invention preferably by means of two curve levers which, for example, are pivotable by means of a pneumatic drive. Such a pivoting action can be very quickly and very precisely performed based on a signal which corresponds, for example, to a thickness measurement carried out by means of a sensor. In principle, the readjustment causes a radial rotational movement of a control disc to be transformed into an axial movement of a curve ring.

DESCRIPTION OF THE PREFERRED EMBODIMENTS

Figure 1:
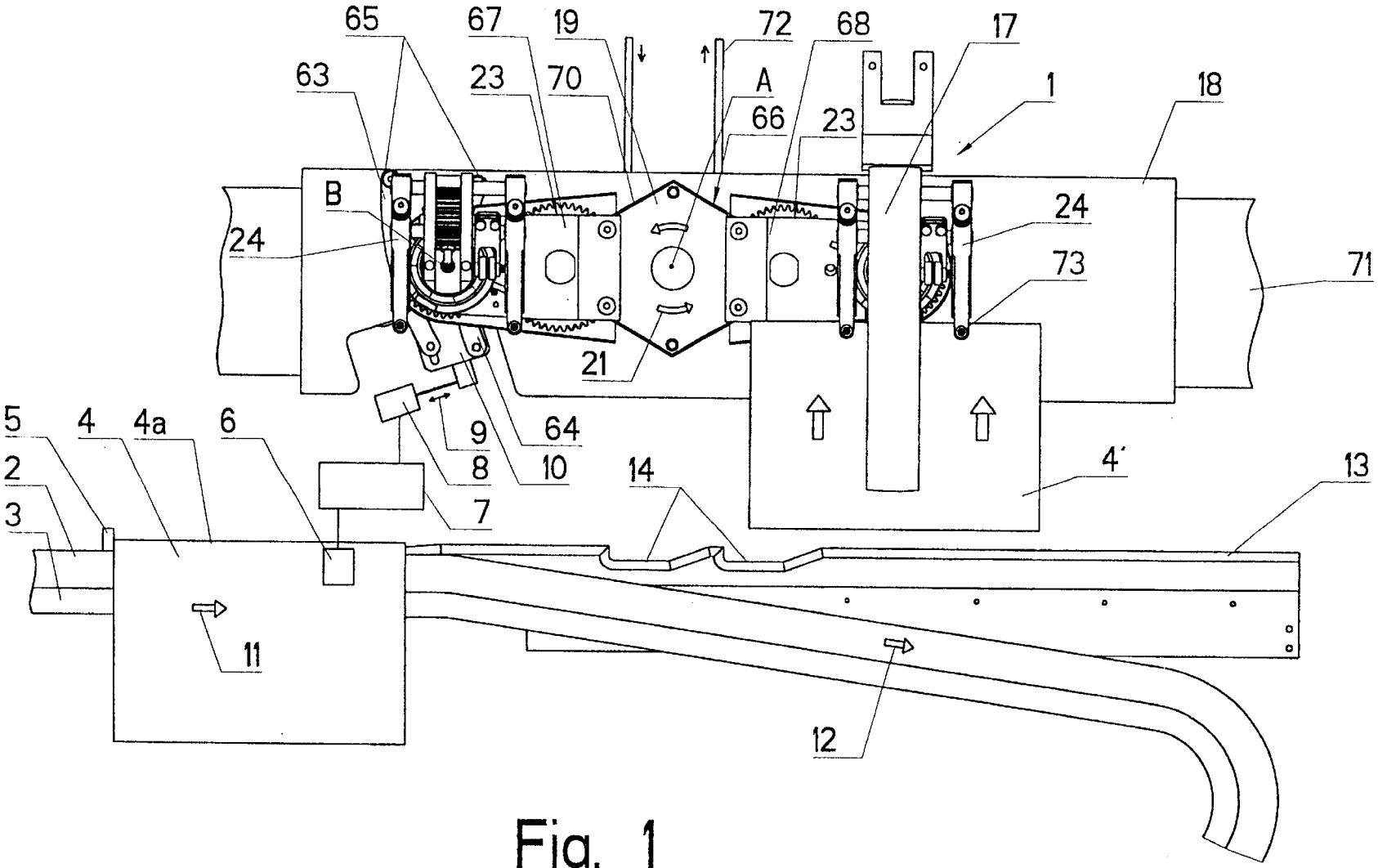
FIG. 1 is a view of the device according to the invention.

The device 1 illustrated in FIG. 1 has a plate 18 which is connected to a frame 71 and on which a gripping device 66 is supported in a rotatable fashion. The gripping device 66 is driven, for example, by means of a drive belt 72 in the direction of the arrows 21 about a horizontal drive axis A. The gripping device 66 has a support 70 which is comprised essentially of a hexagonal flange 19 as well as two bearing plates 23. Each bearing plate 23 is formed as a gripper arm 67, 68. It is also possible to connect, as desired, three gripper arms to the hexagonal flange 19 such that between adjacent gripper arms an angle of 120° is formed, respectively. In principle, an embodiment with only one gripper arm or more than three gripper arms is also conceivable.

Each gripper arm 67, 68 has two grippers 24 with which a printed product 4 of a collecting chain 3 or a similar transport device is gripped and then transferred in a stable position to a further conveying member 17. The conveying member 17, which is only schematically illustrated, is, for example, a wheel which grips a printed product 4' by, for example, a clamping device, not illustrated, and transports the printed product farther downstream.

The collecting chain 3 has a flexible endless chain 2 which has uniformly spaced drivers 5 with which the printed products 4 are transported in a straddling position in a manner known in the art. In FIG. 1, the arrow 12 indicates the running direction of the chain 2. Only portions of the chain 2 are shown. In order for the printed products 4 to be gripped by their fold 4*a*, a so-called sword (blade) 13 is provided onto which the printed products 4 are slipped in the direction of arrow 11. This sword or blade 13 has at its upper side two cutouts 14 directly adjacent to one another. When one of the printed products 4 is positioned in these cutouts 14, it is gripped with two grippers 24 and, as a result of the rotating movement of the gripping device 66, is moved upwardly and transferred onto the conveying member 17. The transfer occurs when the grippers 24 open and release the printed products 4'.

Figure 8A:
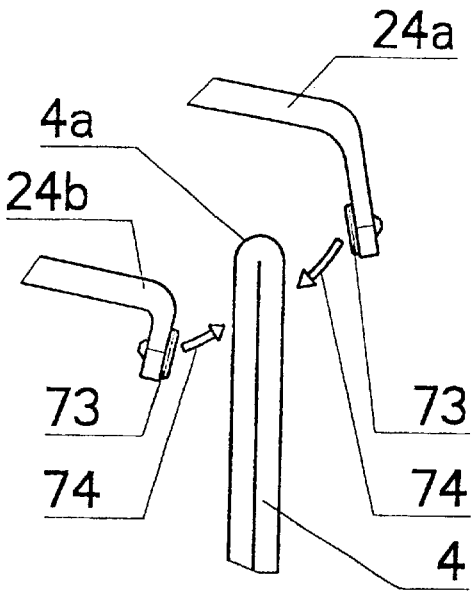
FIGS. 8*a* to 8*c* illustrate schematically the gripping of printed products by means of a gripper.

For securing the printed products, each gripper 24 has a forward free end with a clamping jaw 73 which, according to FIG. 8*a*, can be moved toward one another in the direction of arrow 74 for securing the printed products 4. The two gripper arms 67, 68 have two grippers 24, respectively, as illustrated in FIG. 1. The two grippers 24 of a gripper arm 67, 68 are rotatable about a horizontal axis B, respectively, and, when rotating the carrier 70, are rotated about the axis B in the counter direction such that the grippers 24 are always aligned vertically according to FIG. 1. The clamping jaws 73 of a gripper pair 24 are thus positioned always on a horizontal line and are thus always at a same spacing to the fold 4*a* of the printed products 4 to be gripped.

Figure 2:
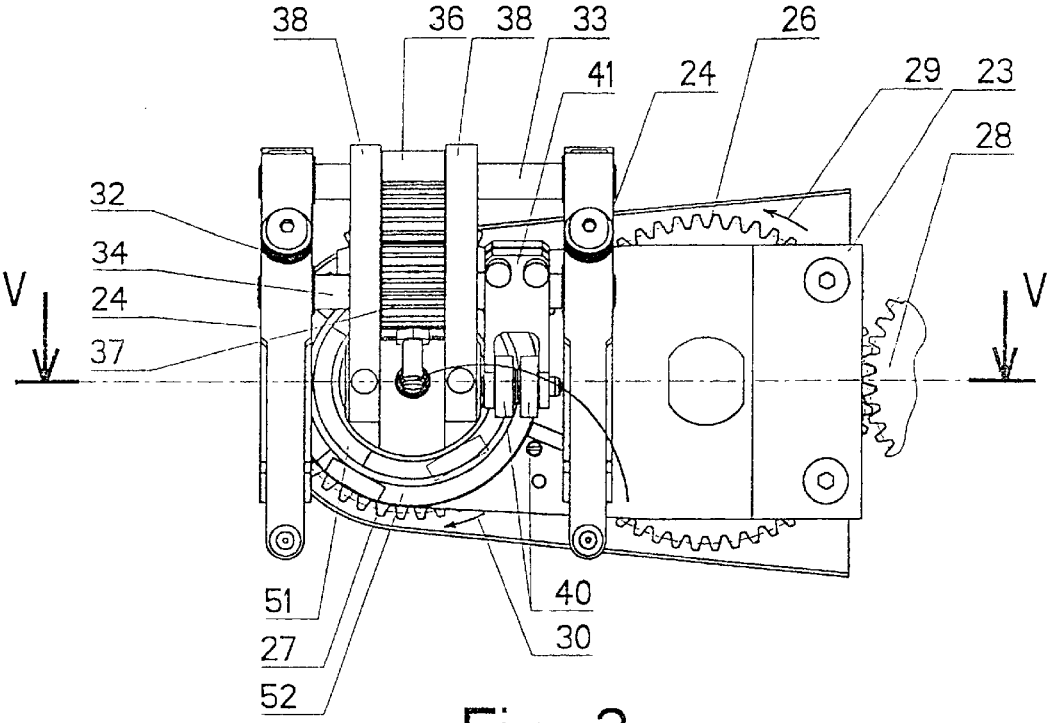
FIG. 2 is a partial view of the device according to the invention of FIG. 1.
Figure 3:
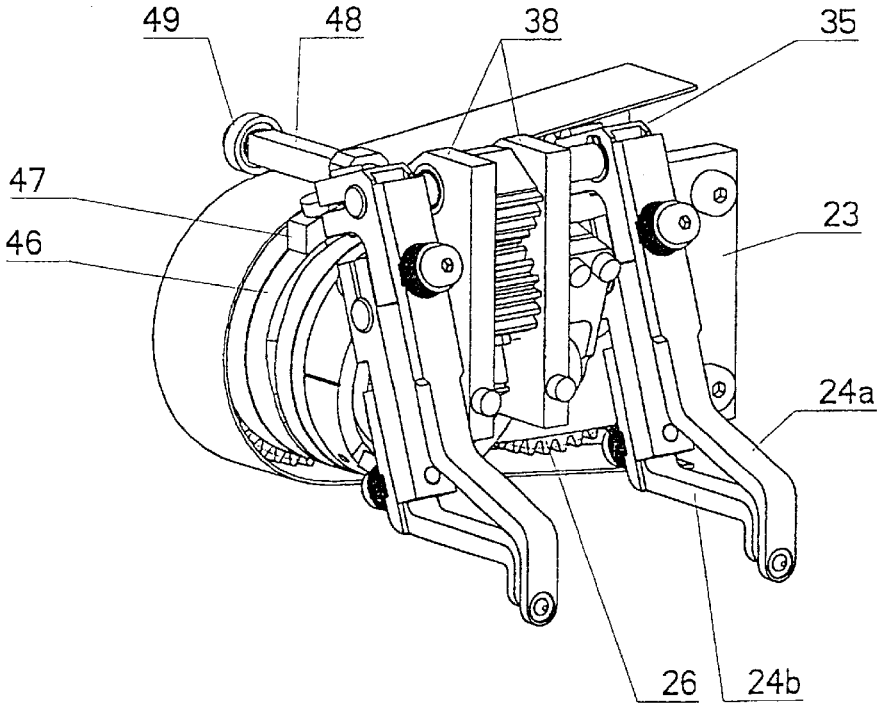
FIG. 3 is a perspective view of the portion of the device illustrated in FIG. 2.
Figure 4:
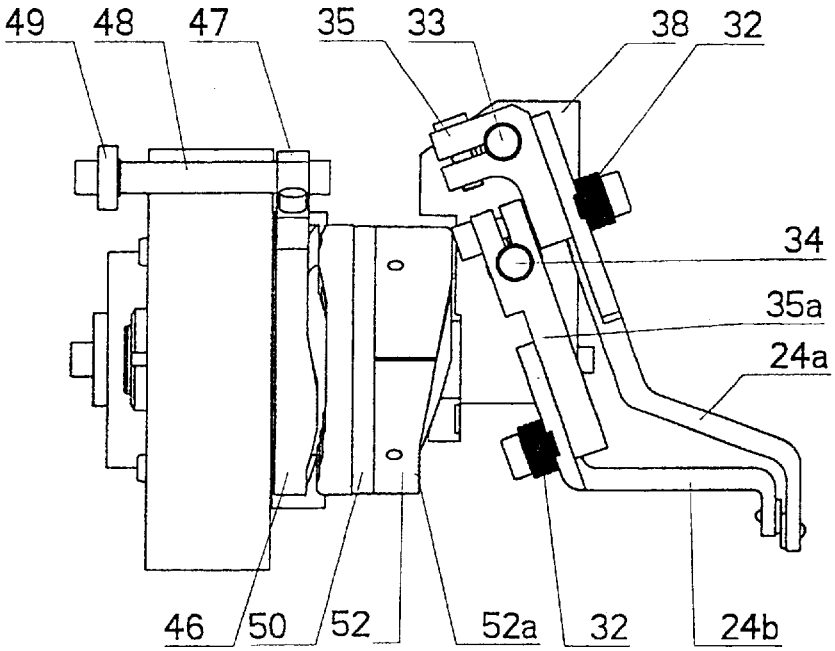
FIG. 4 is an end view of the gripping device.

In order for the aforementioned alignment of the grippers 24 to be ensured, an intermediate gear 26 is rotatably supported on each one of the bearing plates 23. According to FIG. 2, gear 26 meshes with a central gear 28 as well as an outer gear 27. The central gear 28 is arranged coaxially to the drive axis A and fixedly connected to the bearing plate 18. In FIG. 1, the central gear 28 is positioned behind the flange 19 and is thus not visible. When the gripping device 66 in FIG. 1 is driven according to the arrows 21 in a counterclockwise direction, the intermediate wheels 26 are forcibly rotated in the counterclockwise direction, as illustrated in FIG. 2 by arrow 29. The outer wheels 27 rotate, on the other hand, in the clockwise direction, as indicated in FIG. 2 by arrow 30. According to FIG. 6, the gears 27 are fixedly connected by means of a hollow shaft 61, respectively, to two bearing plates 38. The bearing plates 38 are arranged at a spacing to one another and, according to FIG. 2, an upper shaft 33 and a lower shaft 34 are supported on the bearing plates 38. The hollow shafts 61 penetrate each one of the two bearing plates 23 and are rotatably supported therein by means of a bearing 53; see FIG. 6.

The rotational movements of the gears 27 are thus transmitted respectively by the hollow shaft 61 onto the two bearing plates 38. The gears 26, 27, and 28 are formed such that the hollow shafts 61 are rotated relative to the bearing plates 23 such that the two bearing plates 38 are always aligned according to FIG. 1 in a vertical position.

Figure 6:
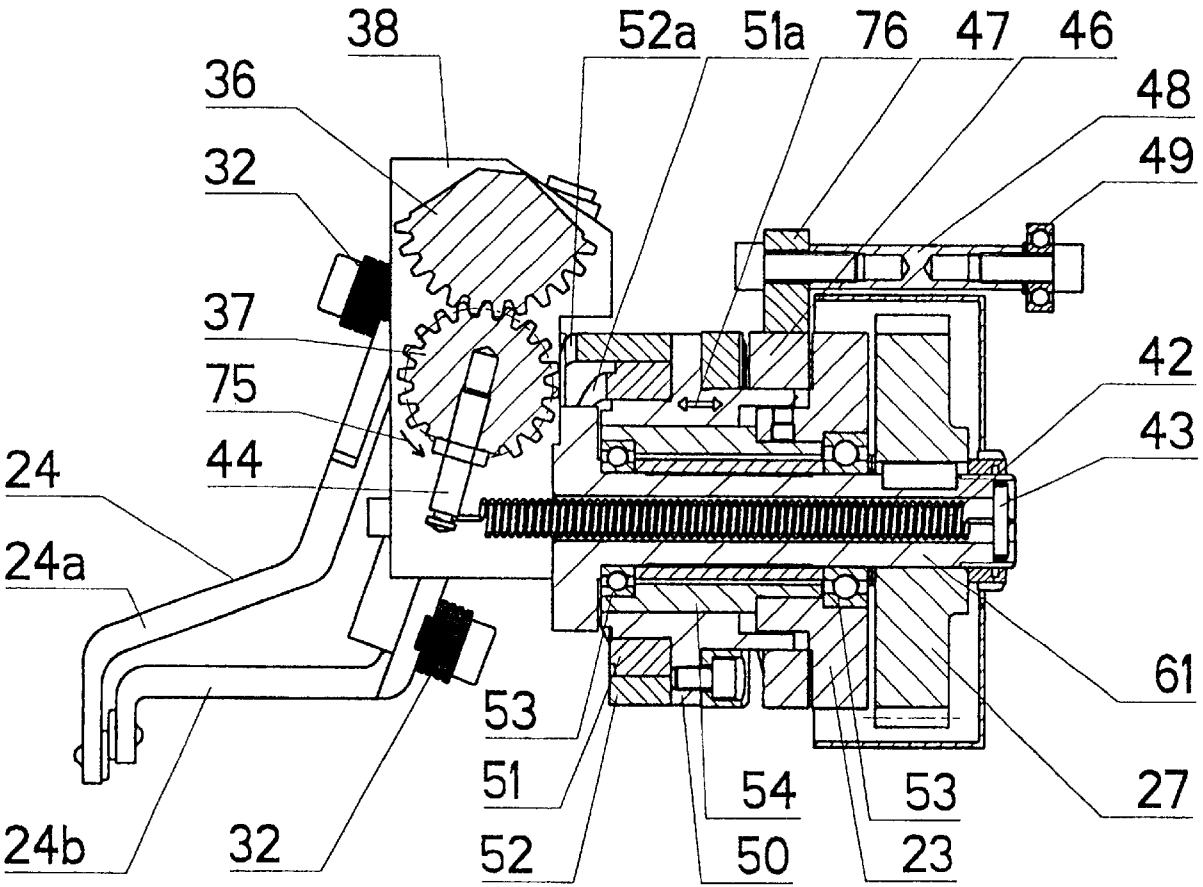
FIG. 6 is a vertical section of the gripping device according to FIGS. 2 and 3.
Figure 7:
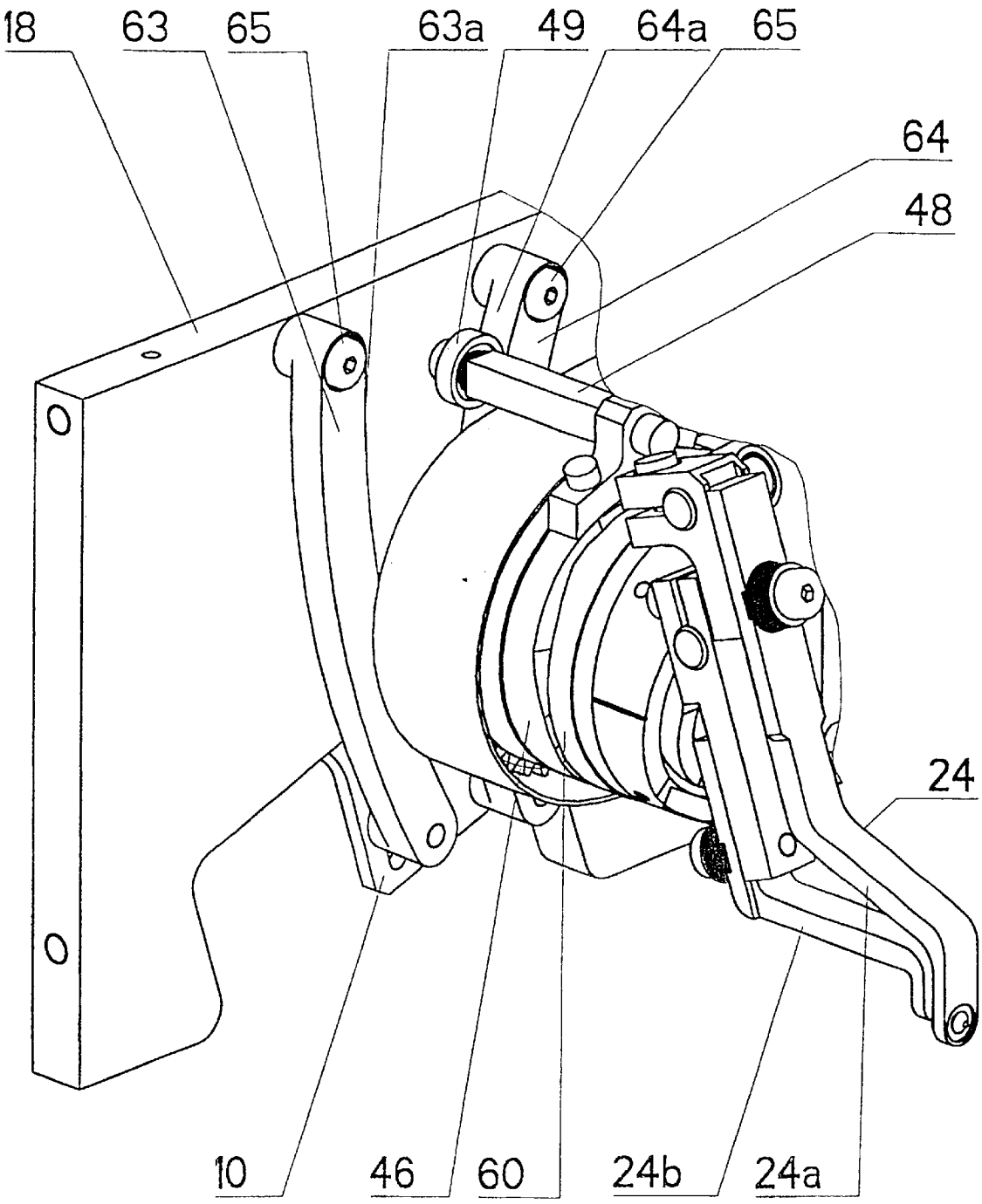
FIG. 7 is a partial view of the device according to the invention.

As mentioned above, on the bearing plates 38 an upper shaft 33 and a lower shaft 34 are rotatably supported. On the upper shaft 33 two upper gripping arms 24*a* are fastened at a spacing to one another. For their attachment, a clamping part 35 is mounted on the gripping arms 24*a*, respectively. On the upper shaft 33, a gear segment 36 is fixedly connected which is arranged between the two bearing plates 38 and meshes with a gear 37 which is fixedly connected to the lower shaft 34. The two axles 33 and 34 are thus in interactive connection by means of the meshing gear segment 36 and gear wheel 37. When rotating the shaft 34, the upper shaft 33 thus rotates in the opposite direction. On the lower gear 37, according to FIG. 6, a radially projecting bolt 44 is fastened on which a tensioned coil spring 42 engages. This spring 42 according to FIG. 6 is fastened with one end to the bolt 43 and penetrates the hollow shaft 61. The tension of the spring 42 causes a torque in the counterclockwise direction on the gear 37 shown in FIG. 6. This torque is illustrated in FIG. 6 by means of the arrow 75. This torque is exerted onto the lower shaft 34 which, as mentioned above, is rotationally fixedly connected with the upper shaft 33. On the lower shaft 34, according to FIG. 2, a pivot lever 41 is fixedly connected on which two rollers 40 are supported. As a result of the aforementioned torque, these two rollers 40 are now pressed against an opening ring 52 or a closing ring 51. These two rings 51 and 52 have, according to FIG. 6, a control curve 51*a* and 52*a*, respectively. By means of these control curves 51*a* and 52*a*, the pivot lever 41 is pivoted against the return force of the spring 42 about the axis of the shaft 34. This pivot movement is transmitted onto the gear 37 and onto the gear segment 36. Accordingly, the gripping arms 24*a* and 24*b* are pivoted for opening and closing the corresponding gripper 24. The pivoting of the gripping arms 24*a* and 24*b* is carried out simultaneously and with oppositely oriented pivot movements. This is the result of the engagement of the gear 37 with the gear segment 36. The clamping jaws 73 thus simultaneously move away from one another or, according to FIG. 8*a*, move toward one another for gripping a printed product 4.

Figure 5:
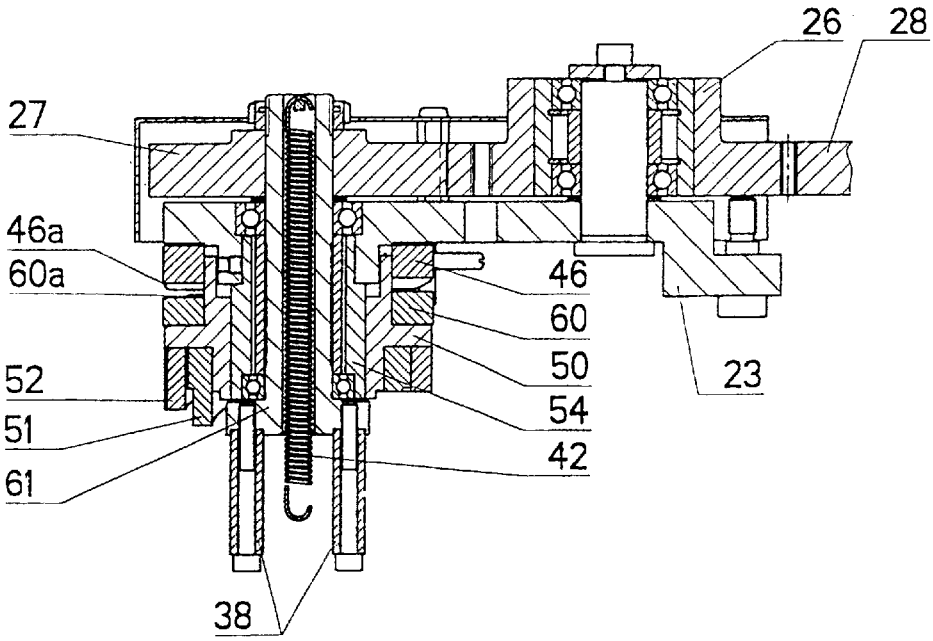
FIG. 5 is a section along the line V—V of FIG. 2.

The opening ring 52 and the closing ring 51 according to FIGS. 5 and 6 are arranged on a flange 50 which is supported so as to be axially or horizontally slidable on a bearing sleeve 54, as illustrated in FIG. 6 by the double arrow 76. For moving this flange 50, a control disc 46 is rotatably supported thereon which at its end face has a curved surface 46*a* which cooperates with a curve 60*a* of a further control disc 60, as illustrated in FIG. 5. Upon rotation of the control disc 46, the curved disc 60 and thus the flange 50 are axially moved in the direction of double arrow 76.

For rotating the control disc 46, a radially projecting stay 47 is fastened thereto and has connected thereto a roller holder 48. A roller 49 is supported on this roller holder 48 and rolls on a convex curve 64*a* of a curve lever 64 or on a concave curve 63*a* of a curve lever 63 when the support 70 is rotating. These two curve levers 63 and 64 are supported on the bearing plate 18 with their upper end so as to be pivotable about a rotational axle 65. For pivoting the levers 64 and 63, they are connected with their lower ends to the drive plate 10 which, according to FIG. 1, is pivotal in the direction of double arrow 9 by means of the drive 8. The two levers 63 and 64 are thus pivoted together about the axes 65. The drive 8 is, for example, a pneumatic drive. However, conceivable is also another drive, for example, an electric drive with an electric motor. Depending on the position of the drive plate 10, the roller 49 runs on the curve 64*a* or the curve 63*a*. By means of the curve 64*a*, the control disc 46 can be rotated in the counterclockwise direction. By means of the curve 63*a*, on the other hand, the control disc 46 can be rotated in the clockwise direction. The two curves 63*a*, 64*a* thus form a through channel.

These rotational movements are always carried out when the two grippers 24 are in the position illustrated in FIG. 1. In this position, the grippers 24 are open, as illustrated in FIG. 8*a*. After this position, i.e., after the roller 49 has passed along the two curve levers 63 and 64, the corresponding grippers 24 are closed when reaching the two cutouts 14. Since, as has been mentioned above, the opening is realized by rolling of the outer one of the two rollers 40 on the opening ring 52, the axial position of this opening ring 52 affects the opening width of the corresponding grippers 24. When the opening ring 52 in FIG. 6 is positioned comparatively far to the left, the two paired grippers 24 are opened by a comparatively small angle. When the opening ring 52, on the other hand, is positioned farther to the right in FIG. 6, the two grippers 24 are opened with a greater angle. The closing movement, on the other hand, is affected by the axial position of the closing ring 51. During clamping, the gripping arms 24*a*, 24*b* are tensioned against the pretensioned disc spring 32. When surpassing a predetermined clamping force, the gripping arms 24*a*, 24*b* are pivoted relative to the clamping parts 35 and 35*a* and the disc springs are compressed.

Figure 8B:
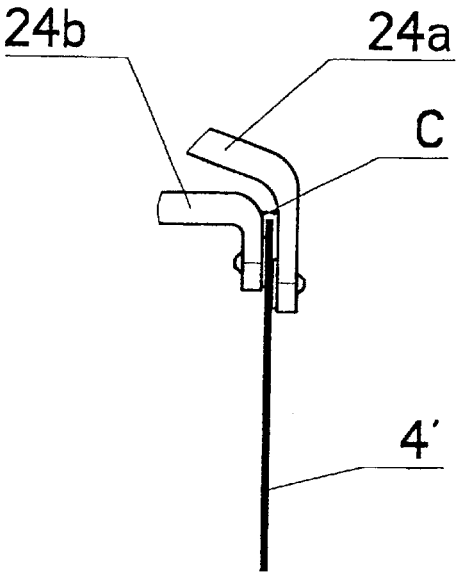
Figure 8C:
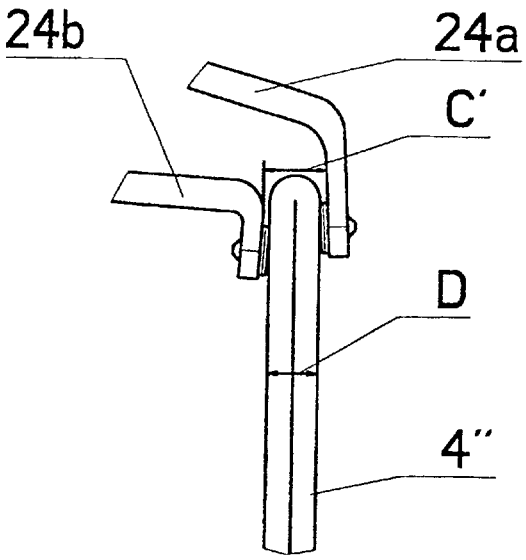

The FIGS. 8*a* to 8*c* show schematically the clamping of printed products 4, 4', 4" of different thickness. For gripping, the gripping arms 24*a*, 24*b* according to FIG. 8*a* are pivoted relative to one another in the directions of arrows 74. This closing movement is controlled by the closing ring 51 or the control curve 51*a* on which the outer one of the two rollers 40 is running. In order to engage the comparatively thin printed product 4' with a suitable pressing force, the two gripping arms 24*a*, 24*b* are moved to a comparatively short spacing C, as illustrated in FIG. 8*b*. In order to achieve this, the closing ring 51 in FIG. 6 is moved comparatively far to the left and the spring 42 is comparatively strongly tensioned. In order to grip a comparatively thick product 4", the two gripping arms 24*a*, 24*b* according to FIG. 8*c* are moved to a correspondingly greater spacing C'. Between the spacings C and C' all intermediate spacings can be adjusted in a continuous fashion. As a result of the positioning of the curve 52*a* not only the clamping force is controlled but also the speed with which the grippers 24 close and open. The printed products 4 to 4" can thus be gripped with the optimal clamping force, respectively, and can also be gripped or released at a suitable point in time. This allows handling of a large thickness range D, as is illustrated in FIGS. 8*b* and 8*c*. Since, as mentioned above, the opening ring 52 and the closing ring 51 can be positioned for each pass by the two control levers 63 and 64, it is possible for directly following printed products 4 to have very different thicknesses. The opening parameter C, respectively, the clamping force is adjusted in any situation in an optimal way. Since the adjustment is mechanical and forced, a very quick readjustment is possible, for example, within 100 milliseconds or less. The readjustment is carried out as a result of a thickness measurement by means of a measuring device 6 which according to FIG. 1 is positioned upstream of the blade 13 and which has, for example, a sensor. The measured value is transmitted to the control 7 which controls correspondingly the drive 8.

The device 1 according to the invention is preferably a so-called delivery for a gather-stitcher device; however, other applications are also conceivable in which printed products must be gripped while being transported and transferred in a stable position to a further device.

In the following, a working cycle is explained in more detail.

In one working cycle the gripping device 66 is rotated about the drive axis A by 360°. This rotational movement is synchronized with the running of the chain 2. The axes B during such a cycle describe, respectively, a circle whose center is the drive axis A. With two gripper arms 67, 68 according to the embodiment shown in FIG. 1 two printed products 4 are gripped and lifted off the blade 13 and then transferred onto a further device 17 during such a working cycle.

The gripping of a printed product is carried out according to FIG. 1 approximately at the 6 o'clock position. The printed product is released shortly thereafter approximately in the three o'clock position. Between these two positions the opening ring 52 is thus active. The adjustment of the opening ring 52 and of the closing ring 51 is realized in the area of the curves 63*a* and 64*a* and thus approximately in the 9 o'clock position. Subsequently, the closing ring 51 becomes active and closes the grippers 24 as soon as they have reached the cutouts 14 of the blade 13.

The curve levers 63 and 64 are adjusted only when a printed product 4 is detected by the measuring device 6 that has a thickness different from that of the preceding printed product. The adjustment is carried out at the latest when the roller 49 is positioned between the two curve levers 63 and 64.

While specific embodiments of the invention have been shown and described in detail to illustrate the inventive principles, it will be understood that the invention may be embodied otherwise without departing from such principles.

What is claimed is:

1. A device for removing printed products having a fold and being transported uniformly spaced and astraddle by a transport device, the device comprising:

a rotatingly driven gripping device comprising controlled gripping elements configured to grip one of the printed products by the fold on the transport device and remove the printed product while stably holding the printed product;

the rotatingly driven gripping device further comprising control elements configured to control at least one of an opening movement and a closing movement of the gripping elements;

a measuring device connected to the control elements and configured to measure the thickness of the printed product, wherein the control elements are configured to be adjusted during running to the thickness of the printed product measured by the measuring device.

2. The device according to claim 1, wherein the gripping elements comprise at least one gripper with two gripping arms, wherein the two gripping arms are configured to be simultaneously moved for carrying out the opening and closing movements.

3. The device according to claim 2, wherein the gripping elements comprises two shafts and wherein the two gripping arms are connected fixedly to one of the two shafts, respectively.

4. The device according to claim 3, wherein the gripping elements further comprises meshing gears mounted on the two shafts such that a rotation of one of the two shafts is transmitted onto the other of the two shafts.

5. The device according to claim 4, wherein one of the meshing gears is a gear segment.

6. The device according to claim 2, wherein the gripping elements further comprise a clamping member and wherein the gripping arms have disk springs configured to press the gripping arms against the clamping part.

7. The device according to claim 1, wherein the gripping elements have two grippers positioned at a spacing from one another and wherein the two grippers form a pair configured to grip simultaneously the printed product.

8. The device according to claim 1, wherein the gripping device comprises gripper arms and a central stationary gear, wherein the gripping elements are supported on the gripper arms, respectively, and have gears, respectively, configured to mesh with the central stationary gear for a constant alignment of the gripping element to one another.

9. The device according to claim 8, wherein the gears comprise an intermediate gear, rotatingly mounted on a bearing plate, and an outer gear, wherein the intermediate gear meshes with the central stationary gear and the outer gear.

10. The device according to claim 1, wherein the control elements comprise at least one of an opening ring and a closing ring, wherein the control elements further comprise a rotatably supported control disk configured to cooperate with adjustable curves during each cycle while running, wherein the rotational movement of the control disk is transformed into an axial movement of at least one of the closing ring and the opening ring.

11. The device according to claim 10, comprising a drive, wherein the adjustable curves form a through channel and are configured to be adjustable based on the thickness of the printed product measured by a measuring device by means of the drive.

12. The device according to claim 11, wherein the drive is a pneumatic drive or a motoric drive.

13. The device according to claim 10, wherein the control elements comprise rollers configured to control the opening and closing movements of the gripping elements, wherein the rollers are configured to roll on at least one circular curve provided on at least one of the opening ring and the closing ring.

14. The device according to claim 13, wherein the rollers are springably pressed against the at least one circular curves.

15. The device according to claim 14, wherein the control elements comprise a coil spring configured to press the rollers against the at least one circular curve.

16. The device according to claim 15, wherein the gripping elements have a hollow shaft providing a rotational axis for the gripping elements, wherein the coil spring is arranged in the hollow shaft.

17. The device according to claim 1, further comprising a conveying member configured to convey the printed products away from the gripping device, wherein the conveying member is arranged in a transport plane of the gripping device at an unloading end of the gripping device, wherein the conveying member has a receiving element configured to receive the printed products and facing the gripping element, wherein the receiving member is arranged between two grippers of the gripping element.

* * * * *